US012703921B2

(12) United States Patent
Krishnamurthy et al.

(10) Patent No.: US 12,703,921 B2
(45) Date of Patent: Aug. 11, 2026

(54) LITHIUM-MEDIATED ELECTROCHEMICAL AMMONIA SYNTHESIS

(71) Applicants: CARNEGIE MELLON UNIVERSITY, Pittsburgh, PA (US); MASSACHUSETTS INSTITUTE OF TECHNOLOGY, Cambridge, MA (US)

(72) Inventors: Dilip Krishnamurthy, Pittsburgh, PA (US); Venkatasubramanian Viswanathan, Pittsburgh, PA (US); Nikifar Lazouski, Cambridge, MA (US); Karthish Manthiram, Cambridge, MA (US)

(73) Assignees: CARNEGIE MELLON UNIVERSITY, Pittsburgh, PA (US); MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 712 days.

(21) Appl. No.: 18/011,446

(22) PCT Filed: Aug. 18, 2021

(86) PCT No.: PCT/US2021/046502

§ 371 (c)(1),
(2) Date: Dec. 19, 2022

(87) PCT Pub. No.: WO2022/040311

PCT Pub. Date: Feb. 24, 2022

(65) Prior Publication Data

US 2025/0092534 A1 Mar. 20, 2025

Related U.S. Application Data

(60) Provisional application No. 63/066,841, filed on Aug. 18, 2020.

(51) Int. Cl.
*C25B 1/27* (2021.01)
*C25B 9/17* (2021.01)
*C25B 11/046* (2021.01)

(52) U.S. Cl.
CPC ..... *C25B 1/27* (2021.01); *C25B 9/17* (2021.01); *C25B 11/046* (2021.01)

(58) Field of Classification Search
CPC C25B 1/27; C25B 9/17; C25B 11/046; C25B 3/23; C25B 11/077; C25B 11/081; C25B 1/50; C01C 1/04; C25C 3/02
See application file for complete search history.

(56) References Cited

U.S. PATENT DOCUMENTS

2009/0259045 A1* 10/2009 Ooka ..... C07D 221/22 546/183
2012/0241328 A1* 9/2012 Joshi ..... C25B 13/04 205/552

FOREIGN PATENT DOCUMENTS

WO WO-2019144087 A1 * 7/2019 ..... C01D 15/04

OTHER PUBLICATIONS

"Understanding Continuous Lithium-Mediated Electrochemical Nitrogen Reduction" by Lazouski et al., Joule 3(4), pp. 1127-1139 (2019).*

(Continued)

*Primary Examiner* — Bryan D. Ripa
(74) *Attorney, Agent, or Firm* — KDW FIRM PLLC

(57) ABSTRACT

In some aspects, the present disclosure pertains to methods for the electrochemical production of $NH_3$ from nitrogen gas and a hydrogen-containing molecule in an electrochemical cell that comprises a cathode, an anode and a lithium-ion-containing electrolyte disposed between the cathode and the anode. The electrochemical cell is operated under conditions such that lithium ions in the electrolyte are converted to lithium metal at the cathode, the lithium metal reacting with (Continued)

nitrogen gas to form $Li_3N$, and the $Li_3N$ reacting with protons in a proton donor to form $NH_3$, lithium ions and a deprotonated proton donor. Moreover, the proton donor has a Kamlet-Taft alpha parameter ($\alpha$) greater than 0.7 and a Kamlet-Taft beta parameter ($\beta$) greater than 0.5. Other aspects of the present disclosure pertain to systems for electrochemical production of $NH_3$.

14 Claims, 6 Drawing Sheets

(56) References Cited

OTHER PUBLICATIONS

"Understanding Continuous Lithium-Mediated Electrochemical Nitrogen Reduction" by Lazouski et al., Joule 3, pp. 1127-1139 (Apr. 17, 2019).*

"Kamlet-Taft Solvent Parameters" accessed from http://www.stenutz.eu/chem/solv26.php (published online before Mar. 2012).*

Lazouski et al., "Understanding Continuous Lithium-Mediated Electrochemical Nitrogen Reduction," Joule, vol. 3, Issue 4, 2019, pp. 1127-1139.

Kamlet-Taft solvent parameters—http://www.stenutz.eu/chem/solv26.php—retrieved Oct. 8, 2021.

Dilip Krishnamurthy et al., "Closed-Loop Design of Proton Donors for Lithium-Mediated Ammonia Synthesis with Interpretable Models and Molecular Machine Learning" arXiv:2008.08078v2 [physics.chem-ph] Aug. 19, 2020.

International Search Report and Written Opinion for the International Patent Application No. PCT/US2021/046502, mailed Nov. 26, 2021, 13 pages.

International Preliminary Report on Patentability for the International Application No. PCT/US2021/046502, mailed Nov. 26, 2021, 6 pages.

* cited by examiner

LITHIUM-MEDIATED ELECTROCHEMICAL AMMONIA SYNTHESIS

RELATED APPLICATIONS

This application is a national phase filing under 35 U.S.C. § 371 claiming the benefit of and priority to International Patent Application No. PCT/US22/26524, filed Apr. 27, 2022, entitled "SYSTEM AND METHOD FOR DEEP LEARNING FOR TRACKING CORTICAL SPREADING DEPRESSING USING EEG", which claims the benefit of U.S. Provisional Patent Application No. 63/066,841, filed Aug. 18, 2020. The contents of these applications are incorporated herein in their entirety entireties.

GOVERNMENT RIGHTS

This invention was made with Government support under contracts CBET1554273, CBET1944007, and DGE1122374 awarded by the National Science Foundation. The Government has certain rights in this invention.

BACKGROUND

The present disclosure relates generally to the field of ammonia synthesis.

Ammonia is an industrial chemical that is used to produce a variety of nitrogen-containing compounds such as fertilizers, pharmaceuticals, and polymers. In addition to being a useful synthetic molecule, ammonia ($NH_3$) is also emerging as an attractive carbon-free energy carrier, as it can be liquefied at moderate pressures (>10 bar) at room temperature. The volumetric density of liquid ammonia greatly exceeds that of lithium-ion batteries and is competitive with other chemical storage media, such as pressurized and liquid hydrogen. $NH_3$ is typically produced via the Haber-Bosch process at high temperatures (450-550° C.) and pressures (up to 200 bar). The process produces up to 1.44% of the world's carbon dioxide emissions due to its use of fossil fuels as a hydrogen source and is economically viable only in large, centralized plants.

With falling renewable energy prices, there is an incentive to produce $NH_3$ in a distributed manner using renewable energy. Electrochemical methods have been proposed to produce ammonia in a distributed manner from intermittent power sources with no $CO_2$ emissions and low capital costs. While a large number of catalyst compositions and electrolyzer configurations have been proposed for electrochemical nitrogen reduction (McPherson et al. 2019, "Materials for electrochemical ammonia synthesis." *Dalton Trans.* 48 (5). Royal Society of Chemistry: 1562-8.; Shi et al. 2020, "Rational Catalyst Design for $N_2$ Reduction under Ambient Conditions: Strategies towards Enhanced Conversion Efficiency." *ACS Catal.* 10, (12), 6870-6899), many of them report Faradaic efficiencies and production rates too low for practical utilization. Methods utilizing lithium metal as a mediator report some of the highest Faradaic efficiencies (FEs) and absolute rates, as well as strict and reproducible controls, of proposed electrochemical approaches for $NH_3$ synthesis (Tsuneto, Kudo, and Sakata, 1994, "Lithium-Mediated Electrochemical Reduction of High Pressure $N_2$ to $NH_3$." *J. Electroanal. Chem.* 367 (1-2). Elsevier: 183-88; McEnaney et al., 2017, "Ammonia Synthesis from $N_2$ and $H_2O$ Using a Lithium Cycling Electrification Strategy at Atmospheric Pressure." *Energy Environ. Sci.* 10 (7). Royal Society of Chemistry: 1621-30; Ma et al., 2017, "Reversible Nitrogen Fixation Based on a Rechargeable Lithium-Nitrogen Battery for Energy Storage." *Chem* 2 (4). Elsevier: 525-32; Kim et al., 2018, "Electrochemical Synthesis of Ammonia from Water and Nitrogen: A Lithium-Mediated Approach Using Lithium-Ion Conducting Glass Ceramics." *ChemSusChem* 11 (1). Wiley Online Library: 120-24). In this approach, lithium metal is first produced via electrochemical reduction of lithium ions ($Li^+$, which spontaneously breaks the nitrogen triple bond to produce lithium nitride b (Greenwood and Earnshaw, 1997, Chemistry of the Elements 2nd Edition. Butterworth-Heinemann); this lithium nitride can then react with a proton donor to form ammonia, recovering lithium ions. The approach has been demonstrated to produce ammonia in both batchwise (McEnaney et al. 2017; Ma et al. 2017; Kim et al. 2018) and continuous systems (Tsuneto, Kudo, and Sakata 1994; Lazouski et al. 2019, "Understanding Continuous Lithium-Mediated Electrochemical Nitrogen Reduction." *Joule* 3 (4). Elsevier Inc.: 1127-39; Schwalbe et al. 2020, "A Combined Theory-Experiment analysis of the Surface Species in Lithium Mediated NH3 Electrosynthesis." *ChemElectroChem*, January, celc.201902124; Andersen et al. 2019, "A rigorous electrochemical ammonia synthesis protocol with quantitative isotope measurements." *Nature* 570 (7762): 504-8).

The present disclosure includes the use of specific hydrogen donors in electrochemical methods for producing ammonia. The present disclosure enables, for example, ammonia production using renewable energy in a distributed manner, which may lead to reduced $CO_2$ emissions while facilitating ammonia synthesis at ambient temperature and pressure

BRIEF SUMMARY OF THE INVENTION

In some embodiments, the present disclosure pertains to methods for the electrochemical production of $NH_3$ from nitrogen gas and a hydrogen-containing molecule in an electrochemical cell that comprises a cathode, an anode and a lithium-ion-containing electrolyte disposed between the cathode and the anode. The electrochemical cell is operated under conditions such that lithium ions in the electrolyte are converted to lithium metal at the cathode, the lithium metal reacting with nitrogen gas to form $Li_3N$, and the $Li_3N$ reacting with protons in a proton donor to form $NH_3$, lithium ions and a deprotonated proton donor. The proton donor has a Kamlet-Taft alpha parameter ($\alpha$) greater than 0.7 and a Kamlet-Taft beta parameter ($\beta$) greater than 0.5. In some of these embodiments, the electrochemical cell is operated under conditions such that protons are generated from the hydrogen-containing molecule at the anode, the protons reacting with the deprotonated proton donor to produce the proton donor.

In some embodiments, which may be employed in conjunction with the preceding embodiments, the proton donor is an alcohol that has a Kamlet-Taft alpha parameter ($\alpha$) greater than 0.7 and a Kamlet-Taft beta parameter ($\beta$) greater than 0.5. In some of these embodiments, the alcohol is selected from a monofunctional $C_1$-$C_7$ aliphatic alcohol (e.g., 1-butanol), a difunctional $C_1$-$C_7$ aliphatic alcohol and a trifunctional $C_1$-$C_7$ aliphatic alcohol.

In some embodiments, which may be employed in conjunction with the preceding embodiments, the proton donor is (a) an ionic liquid comprising a cation that has a Kamlet-Taft alpha parameter ($\alpha$) greater than 0.7 and a Kamlet-Taft beta parameter ($\beta$) greater than 0.5, (b) an ionic liquid comprising a anion that has a Kamlet-Taft alpha parameter ($\alpha$) greater than 0.7 and a Kamlet-Taft beta parameter ($\beta$)

greater than 0.5, or (c) and an ionic liquid comprising both a cation that has a Kamlet-Taft alpha parameter ($\alpha$) greater than 0.7 and a Kamlet-Taft beta parameter ($\beta$) greater than 0.5 and a anion that has a Kamlet-Taft alpha parameter ($\alpha$) greater than 0.7 and a Kamlet-Taft beta parameter ($\beta$) greater than 0.5.

In some embodiments, which may be employed in conjunction with the preceding embodiments, the hydrogen-containing molecule may be selected from hydrogen gas, water or an organic hydrogen-containing molecule.

In some embodiments, which may be employed in conjunction with the preceding embodiments, the electrolyte comprises a lithium salt dissolved in a solvent for the lithium salt. In some of these embodiments, the lithium salt is selected from lithium tetrafluoroborate ($LiBF_4$), lithium hexafluorophosphate ($LiPF_6$), lithium hexafluoroarsenate ($LiAsF_6$), lithium perchlorate ($LiClO_4$), lithium triflate ($LiCF_3SO_3$), lithium bisoxalato borate (LiBOB), lithium difluorooxalato borate (LiDFOB), lithium or trifluorosulfonylimide (LiTFSI) and/or the solvent for the lithium salt is selected from ether-containing organic solvents, fluorinated organic solvents and lactones. In some embodiments, the solvent for the lithium salt and the hydrogen-containing molecule are the same.

In some embodiments, which may be employed in conjunction with the preceding embodiments, the cathode is formed from a metal (e.g., a transition metal or transition metal alloy) or a metal oxide.

In some embodiments, which may be employed in conjunction with the preceding embodiments, the anode comprises platinum metal.

In some embodiments, which may be employed in conjunction with the preceding embodiments, the electrochemical cell is operated at a current density greater than 300 $mA/cm^2$ In some embodiments, the present disclosure pertains to systems for the electrochemical production of $NH_3$ from nitrogen gas and a hydrogen-containing molecule. The systems comprise (a) an electrochemical cell that comprises a cathode, an anode and a lithium-ion-containing electrolyte disposed between the cathode and the anode, examples of which are provided above. In some embodiments, the systems comprise an ionically conductive separator positioned between the anode and the cathode. The systems are configured to operate the electrochemical cell under conditions such that (i) lithium ions in the electrolyte are converted to lithium metal at the cathode, with the lithium metal reacting with nitrogen gas to form $Li_3N$, and the $Li_3N$ reacting with protons in a proton donor to form $NH_3$, lithium ions and a proton acceptor and (ii) protons are generated from the hydrogen-containing molecule at the anode, the protons reacting with the proton acceptor to produce the proton donor. The systems may also include a source of the nitrogen gas and a source of the hydrogen-containing molecule, examples of which are provided above. The proton donor used in the systems has a Kamlet-Taft alpha parameter ($\alpha$) greater than 0.7 and a Kamlet-Taft beta parameter ($\beta$) greater than 0.5, as detailed further above. In some embodiments, the systems further comprise a voltage source for supplying energy to operate the electrochemical cell.

DESCRIPTION OF THE DRAWINGS

FIG. 5A: Absorbance spectra obtained from solutions containing known concentrations of ammonia ions in 10 v/v % 1 M $LiBF_4$ in THF electrolyte in water. FIG. 5B: A typical calibration curve made from the spectra in FIG. 5A. The absorbance signal is taken to be the difference between the absorbance at 650 and 475 nm.

DETAILED DESCRIPTION

Figure 1A:
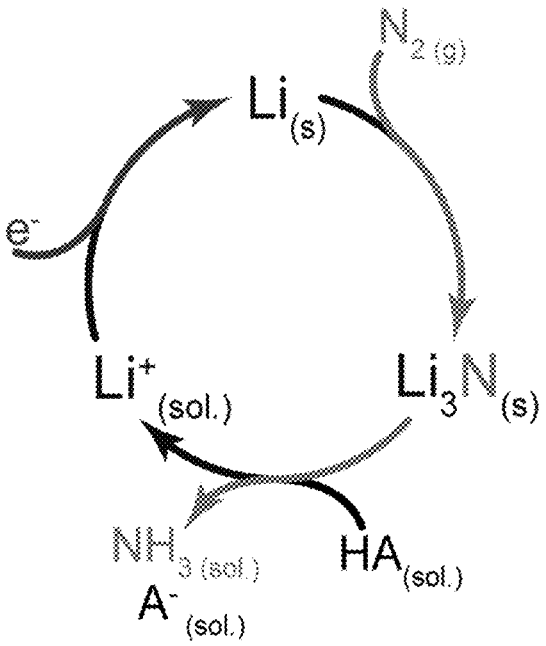
FIG. 1A is a schematic illustration of a lithium-mediated catalytic cycle, with species flows highlighted.
Figure 1B:
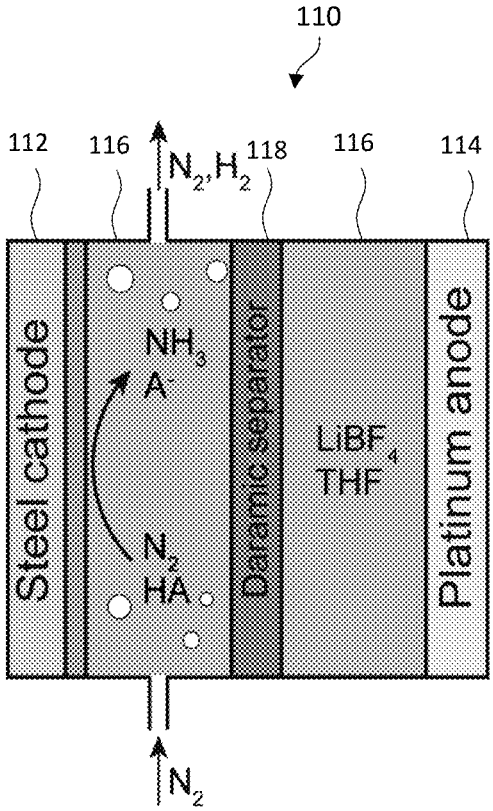
FIG. 1B is a schematic illustration of an electrochemical cell for lithium-mediated ammonia production from nitrogen.
Figure 2A:
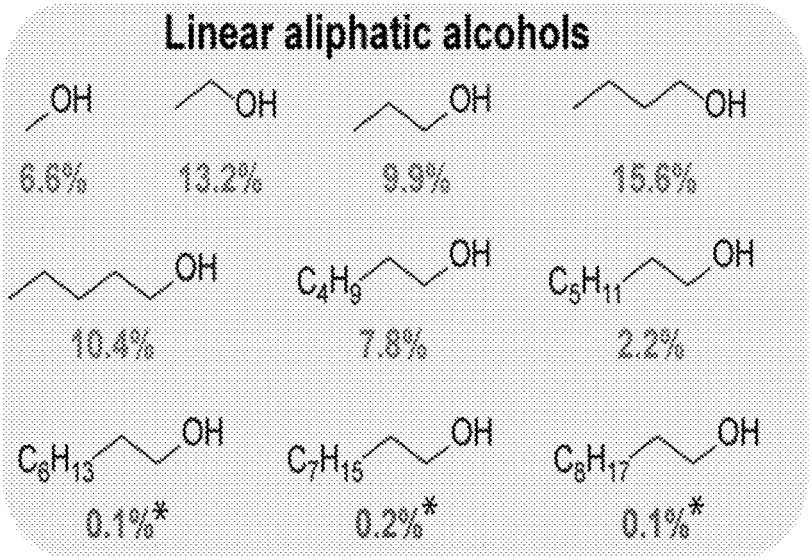
FIGS. 2A-2G show several classes of proton donors which were tested for activity towards the lithium-mediated nitrogen reduction reaction.
Figure 2B:
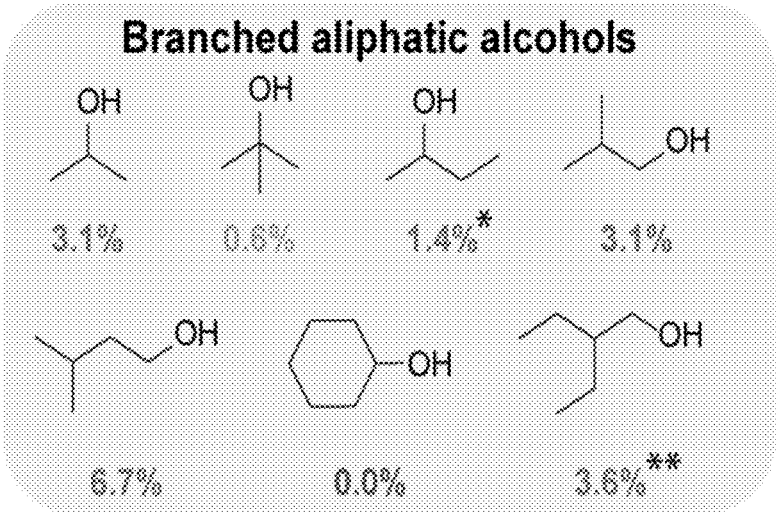
Figure 2C:
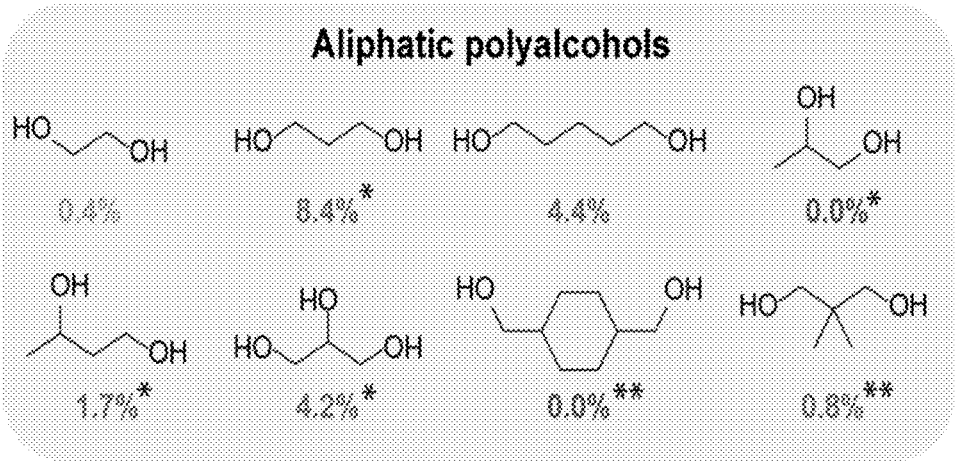
Figure 2D:
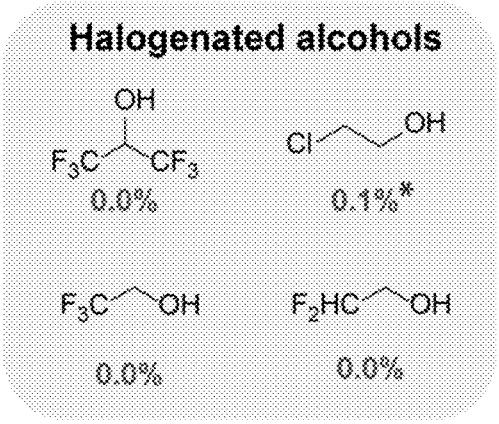
Figure 2E:
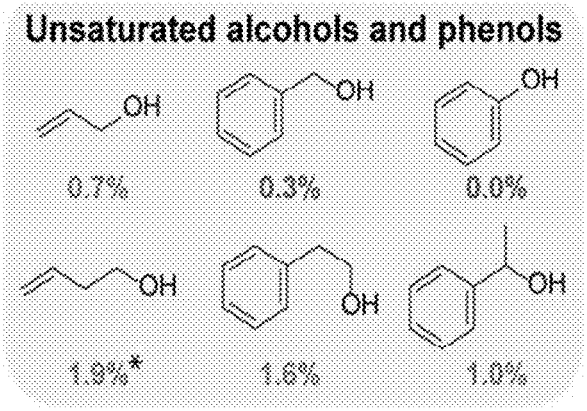
Figure 2F:
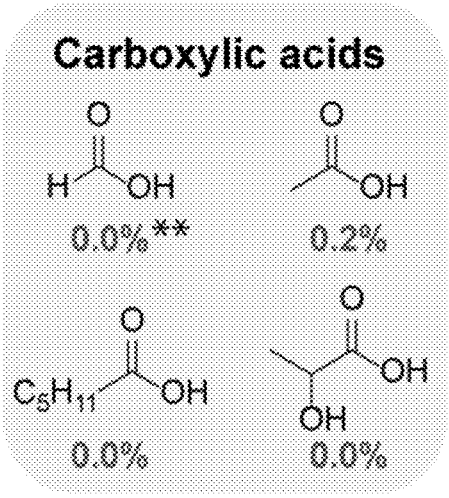
Figure 2G:
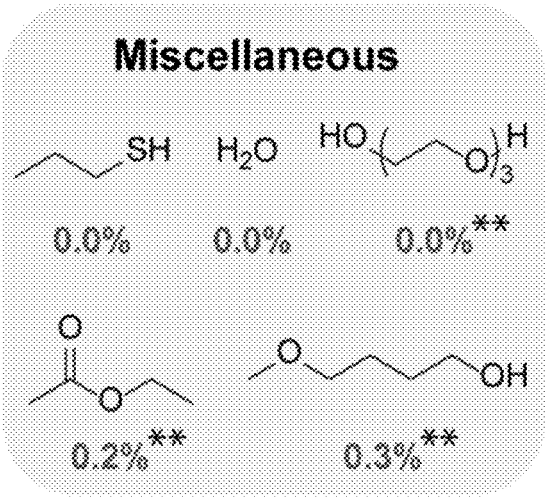

With reference now to FIGS. 1A and 1B, in some aspects, the present disclosure provides for a method for the electrochemical production of ammonia ($NH_3$) from nitrogen gas ($N_2$) and a hydrogen-containing molecule in an electrochemical cell 110 that comprises a cathode 112, an anode 114, and a lithium-ion-containing electrolyte 116 disposed between the cathode 112 and the anode, 114 wherein the electrochemical cell is operated under conditions such that lithium ions $Li^+$ in the electrolyte are converted to lithium metal Li at the cathode 112, the lithium metal reacting with nitrogen gas to form lithium nitride ($Li_3N$), and the $Li_3N$ reacting with protons ($H^+$) in a proton donor (HA) to form $NH_3$, lithium ions and a deprotonated proton donor ($A^-$). In various embodiments, the electrochemical cell 110 is operated under conditions such that protons ($H^+$) are generated from the hydrogen-containing molecule at the anode 114, the protons ($H^+$) reacting with the deprotonated proton donor ($A^-$) to produce the proton donor (HA).

In some aspects, and with continued reference to FIGS. 1A and 1B, the present disclosure also provides for a system for the electrochemical production of $NH_3$ from nitrogen gas and a hydrogen-containing molecule. The system may comprise (a) an electrochemical cell 110 that comprises a cathode 112, an anode 114 and a lithium-ion-containing electrolyte 116 disposed between the cathode 112 and the anode 114. The system is configured to operate the electrochemical cell 110 under conditions such that lithium ions in the electrolyte 116 are converted to lithium metal at the cathode 112, the lithium metal reacting with nitrogen gas to form $Li_3N$, and the $Li_3N$ reacting with protons in a proton donor to form $NH_3$, lithium ions and a proton acceptor. The system is also configured to operate the electrochemical cell 110 under conditions such that and protons are generated from the hydrogen-containing molecule at the anode 114, the protons reacting with the proton acceptor to produce the proton donor. The electrochemical cell 110 may further comprise an ionically conductive separator 118 between the cathode 112 and the anode 114 in some embodiments. The separator may comprise, for example, porous glass or porous polymer such as porous polyethylene or porous polypropylene. In addition to an electrochemical cell 110, the system further comprises a source of the nitrogen gas and a source of the hydrogen-containing molecule. The system also comprises a voltage source such as a DC power source (see, e.g., FIG. 4 below) for supplying energy to operate the electrochemical cell.

Certain embodiments, the electrochemical cell is operated at current density ranging from 100 $mA/cm^2$ to 2500 $mA/cm^2$, typically ranging from 300 $mA/cm^2$ to 1000 $mA/cm^2$.

Examples of hydrogen-containing molecules include hydrogen gas, water, organic hydrogen-containing molecules (e.g., tetrahydrofuran (THF), etc.), and combinations thereof, among others.

Cathode materials include suitable metals or metal oxides (e.g., any metal or metal oxide that does not form an alloy with lithium metal). Specific cathode materials include transition metals such as Ag, Cu, Mo, Ti, Ni, Fe, and alloys of transition metals including stainless steel, among others.

Anode materials include inert metals, particularly, platinum metal.

In some embodiments, the proton donor employed has a Kamlet-Taft alpha parameter ($\alpha$) greater than 0.7 (e.g., ranging anywhere from 0.7 to 2), preferably greater than 0.78, in some cases greater than 0.9, greater than 1.0, or greater than 1.2 and a Kamlet-Taft beta parameter ($\beta$) greater than 0.5 (e.g., ranging anywhere from 0.5 to 1.8), preferably greater than 0.57, in some cases greater than 0.59, greater than 0.7, greater than 0.8, or greater than 0.9.

Thus, in various embodiments, the present disclosure is directed to the use of hydrogen donor molecules with both a Kamlet-Taft alpha parameter ($\alpha$) greater than 0.7, which is indicative of high proton donating ability (high acidity) and a Kamlet-Taft beta parameter ($\beta$) greater than 0.5, which is indicative of high proton accepting ability (high basicity) as components of electrolytes for electrochemical cells, specifically, as components of electrolytes of electrochemical cells which are used for lithium-mediated production of ammonia from nitrogen.

Examples of proton donors are alcohols that have a Kamlet-Taft alpha parameter ($\alpha$) greater than 0.7 and a Kamlet-Taft beta parameter ($\beta$) greater than 0.5, including aliphatic alcohols, which can be linear or branched, saturated or unsaturated. Specific aliphatic alcohols include monofunctional $C_1$-$C_7$ aliphatic alcohols, difunctional $C_1$-$C_7$ aliphatic alcohols and trifunctional $C_1$-$C_7$ aliphatic alcohols, for example, monofunctional $C_2$-$C_5$ aliphatic alcohols, monofunctional $C_3$-$C_5$ aliphatic alcohols, difunctional $C_2$-$C_5$ aliphatic alcohols, difunctional $C_3$-$C_5$ aliphatic alcohols, trifunctional $C_2$-$C_5$ aliphatic alcohols, trifunctional $C_3$-$C_5$ aliphatic alcohols, and combinations thereof, among others.

Examples of proton donors include ionic liquids (which may also be referred to as ionic liquid salts) that comprise a cation having a Kamlet-Taft alpha parameter ($\alpha$) greater than 0.7 and a Kamlet-Taft beta parameter ($\beta$) greater than 0.5. Examples of proton donors also include ionic liquids that comprise an anion having a Kamlet-Taft alpha parameter ($\alpha$) greater than 0.7 and a Kamlet-Taft beta parameter ($\beta$) greater than 0.5. Examples of proton donors further include ionic liquids that comprise both an anion having a Kamlet-Taft alpha parameter ($\alpha$) greater than 0.7 and a Kamlet-Taft beta parameter ($\beta$) greater than 0.5 and a cation having a Kamlet-Taft alpha parameter ($\alpha$) greater than 0.7 and a Kamlet-Taft beta parameter ($\beta$) greater than 0.5.

Particular ionic liquid cations may be selected from members of the following cations that also have a Kamlet-Taft alpha parameter ($\alpha$) greater than 0.7 and a Kamlet-Taft beta parameter ($\beta$) greater than 0.5: ammonium, azepanium, benzimidazolium, 1,8-diazabicyclo[5.4.0]undec-7-ene (DBU), guanidinium, imidazolium, morpholinium, octanium, oxazolidinium, phosphonium, piperidinium, pyrazolium, pyridinium, pyrimidinium, pyrrolidinium, sulfonium and triazolium, among many others. Particular ionic liquid anions may be selected from members of the following anions that also have a Kamlet-Taft alpha parameter ($\alpha$) greater than 0.7 and a Kamlet-Taft beta parameter ($\beta$) greater than 0.5: sulfonate, sulfate, phosphonate, phosphate, bis (trifluoromethanesulfonyl)imide (NTf2), nitrate, halide, dicyanamide, carboxylate, $BF_4$, acetate, phosphite, perchlorate, tricyanomethanide, thiocyanate, $PF_6$, $SbF_6$, and dimethoxy(oxo)phosphanuide, among many others.

In various embodiments, the lithium-ion-containing electrolyte may comprise a lithium salt dissolved in a solvent for the lithium salt. Specific examples of lithium salts include lithium tetrafluoroborate ($LiBF_4$), lithium hexafluorophosphate ($LiPF_6$), lithium hexafluoroarsenate ($LiAsF_6$), lithium perchlorate ($LiClO_4$), lithium triflate ($LiCF_3SO_3$), lithium bisoxalato borate (LiBOB), lithium difluorooxalato borate (LiDFOB), lithium, trifluorosulfonylimide (LiTFSI), and combinations thereof, among others. Specific examples of solvents for the lithium salt include ether-containing organic solvents (e.g., dimethoxyethane, THF, THF-derivatives, such as monomethyl THF and dimethyl THF, diglyme, and tetraglyme, fluorinated organic solvents, lactones, such as gamma-butyrolactone and gamma-valerolactone, and combinations thereof, among others.

As see from the above, during the lithium-mediated nitrogen reduction reaction, a proton donor in the electrolyte is required for converting fixed nitrogen in the form of lithium nitride to ammonia. As lithium nitride and its derivatives, imide and amide, are strong bases (pKa=41 for $NH_3$; Bordwell, Drucker, and Fried 1981, "Acidities of Carbon and Nitrogen Acids: The Aromaticity of the Cyclopentadienyl Anion." *J. Org. Chem.* 46 (3): 632-35), it is likely that many compounds irrespective of structure can thermodynamically promote liberation of ammonia from nitride. However, there appears to exist a threshold concentration of proton donor below which nitride ammonia and lithium nitride may not be detected following electrolysis of a lithium-ion-containing solution (Lazouski et al. 2019; Tsuneto, Kudo, and Sakata 1994). This suggests that the proton donor plays another role in the lithium-mediated nitrogen reduction reaction beyond protonating reduced nitrogen species to ammonia, i.e., that it promotes the reaction to fix the nitrogen to produce reduced nitrogen species, either electrochemically or thermochemically. Moreover, the ability of proton donor to promote nitrogen fixation appears to depend on its structure (Tsuneto, Kudo, and Sakata 1994).

In order to determine whether a given proton donor can promote the lithium-mediated nitrogen reduction reaction, a number of candidate compounds were tested in the Example below at flooded stainless steel electrodes in a range of concentrations in a previously described setup (Lazouski et al. 2019). Briefly, a 1 M $LiBF_4$ in tetrahydrofuran (THF) electrolyte was used in a 2-compartment electrochemical cell with a platinum foil anode, stainless steel foil cathode, and a Daramic™ porous polymer separator (Polypore International Inc., Charlotte, NC, USA). A range of concentrations of proton donors were added to the electrolyte prior to electrolysis. Nitrogen gas was flowed through the cathode compartment while a constant current was applied across the cell. If the proton donor promotes nitrogen reduction, then ammonia forms and can be detected in the electrolyte via a colorimetric assay.

The present inventors have set a threshold for classifying whether or not a proton donor is active in the lithium-mediated nitrogen reduction reaction. If the Faradaic efficiency (FE) towards ammonia in at least one operating condition exceeds 0.5%, then the proton donor is considered active; if all experiments lead to lower FEs, then the proton donor is considered inactive. This threshold was chosen based on the minimum quantifiable FE (~0.1%) and the spread in FE typically observed at low production rates (~0.1%); a threshold value of 0.5% increases the likelihood that a given proton source is indeed active for the lithium-mediated nitrogen reduction reaction when ammonia is detected and reduces the likelihood that the ammonia signal is spurious or comes from adventitious sources (Du et al. 2019, "Critical Assessment of the Electrocatalytic Activity of Vanadium and Niobium Nitrides toward Dinitrogen Reduction to Ammonia." *ACS Sustain. Chem. Eng.* 7 (7): 6839-50; Hu et al. 2019, "Electrochemical Dinitrogen Reduction to Ammonia by Mo 2 N: Catalysis or Decomposition?" *ACS Energy Lett.* 4 (5): 1053-4; Shipman and Symes 2017, "A re-evaluation of Sn(II) phthalocyanine as a catalyst for the electrosynthesis of ammonia." *Electrochim. Acta* 258: 618-22; Dabundo et al. 2014, "The Contamination of Commercial $^{15}$N2 Gas Stocks with $^{15}$N-Labeled Nitrate and Ammonium and Consequences for Nitrogen Fixation Measurements." Edited by Jason B. Love. *PLoS One* 9 (10): e110335).

Several classes of proton donors including alcohols, carboxylic acids, esters, phenols, and thiols were tested for activity towards the lithium-mediated nitrogen reduction reaction (FIGS. 2A-2G). Note that the conditions at which maximum reported FEs were obtained differ between proton sources (Table 1 below). In general, only compounds containing hydroxyl groups were found to be active for the lithium-mediated nitrogen reduction reaction. Compounds containing other functional groups did not produce ammonia at appreciable (>0.5%) FEs and had various effects on the deposited lithium. In the case of carboxylic acids, no significant accumulation of lithium on the cathode surface was observed. For other proton donor classes, including thiols and phenols, significant amounts of lithium metal and likely other reduction products were observed on the surface.

It is noted that not all hydroxyl-containing compounds were found to be active for the lithium-mediated nitrogen reduction reaction, with subtle differences in structure leading to drastic differences in activity. Control experiments confirmed that the difference in ammonia yields was a result of difference in proton donor structure, not due to interference in the colorimetric assay or impurities in the proton donor. Among the proton donors tested, 1-butanol was found to give the highest FE, consistently exceeding that obtainable by using ethanol as a proton donor (15.6% vs. 13.2%). Thus, in various embodiments, 1-butanol is the proton donor of choice in the lithium-mediated nitrogen reduction reaction aimed at high yields of ammonia.

The present inventors also employed a data-driven approach to determine the properties that proton donors should have to promote LM-NRR. Several quantitative properties of proton donors were assessed including measures of solvent strength as acids or bases (acid dissociation constant ($pK_a$), Guttman donor and acceptor numbers (Khetan, Abhishek, Alan Luntz, and Venkatasubramanian Viswanathan. 2015. "Trade-Offs in Capacity and Rechargeability in Nonaqueous Li—O2 Batteries: Solution-Driven Growth Versus Nucleophilic Stability." *J. Phys. Chem.* Lett. 6 (7). ACS Publications: 1254-9; Khetan, Abhishek, Heinz Pitsch, and Venkatasubramanian Viswanathan. 2014a. "Identifying Descriptors for Solvent Stability in Nonaqueous Li—O2 Batteries." *J. Phys. Chem.* Lett. 5 (8). ACS Publications: 1318-23; Gutmann, Viktor. 1976. "Solvent Effects on the Reactivities of Organometallic Compounds." *Coord. Chem. Rev.* 18 (2). Elsevier: 225-55), measures of reactivity (highest occupied molecular orbital (HOMO) and lowest unoccupied molecular orbital (LUMO) levels (McCloskey et al. 2012. "Limitations in Rechargeability of Li—O2 Batteries and Possible Origins." *J. Phys. Chem.* Lett. 3 (20). ACS Publications: 3043-7; Khetan, Pitsch, and Viswanathan 2017. "Effect of Dynamic Surface Polarization on the Oxidative Stability of Solvents in Nonaqueous Li—O2 Batteries." *Phys. Rev.* Mater. 1 (4). APS: 045401; Khetan, Pitsch, and Viswanathan 2014a)), solvatochromatic Kamlet-Taft (KT) parameters ($\alpha$, $\beta$, $\pi^*$ (Crowhurst et al. 2006. "Using Kamlet-Taft Solvent Descriptors to Explain the Reactivity of Anionic Nucleophiles in Ionic Liquids." *J. Org. Chem.* 71 (23). ACS Publications: 8847-53; Wilson and Famini 1991. "Using Theoretical Descriptors in Quantitative Structure-Activity Relationships: Some Toxicological Indices." *J. Med. Chem.* 34 (5). ACS Publications: 1668-74)), measures of ionic character and polarizability (Bader charge), and computable measures of steric hindrance and diffusivity (Bader volume)(Pande and Viswanathan 2019. "Descriptors for Electrolyte-Renormalized Oxidative Stability of Solvents in Lithium-Ion Batteries." J. Phys. Chem. Lett. 10 (22). ACS Publications: 7031-6; Garcia-Mota et al. 2012. "Importance of Correlation in Determining Electrocatalytic Oxygen Evolution Activity on Cobalt Oxides." *J. Phys. Chem. C* 116 (39). ACS Publications: 21077-82).

Figure 3A:
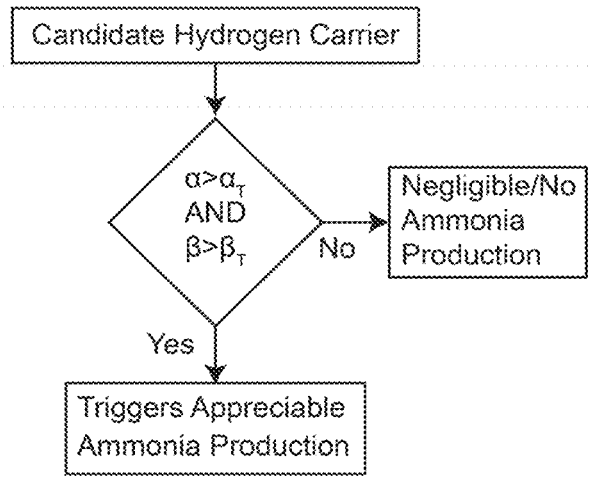
FIG. 3A is a decision tree that has a high classification accuracy (≈95%) and identifies Kamlet-Taft parameters, which quantify hydrogen-bond donor and acceptor abilities (denoted as $\alpha$ and $\beta$, respectively), as the most indicative of the ability to yield ammonia. In some embodiments, associated threshold values for the ability to trigger ammonia production are given by $\alpha_t$=0.78 and $\beta_t$=0.57.
Figure 3B:
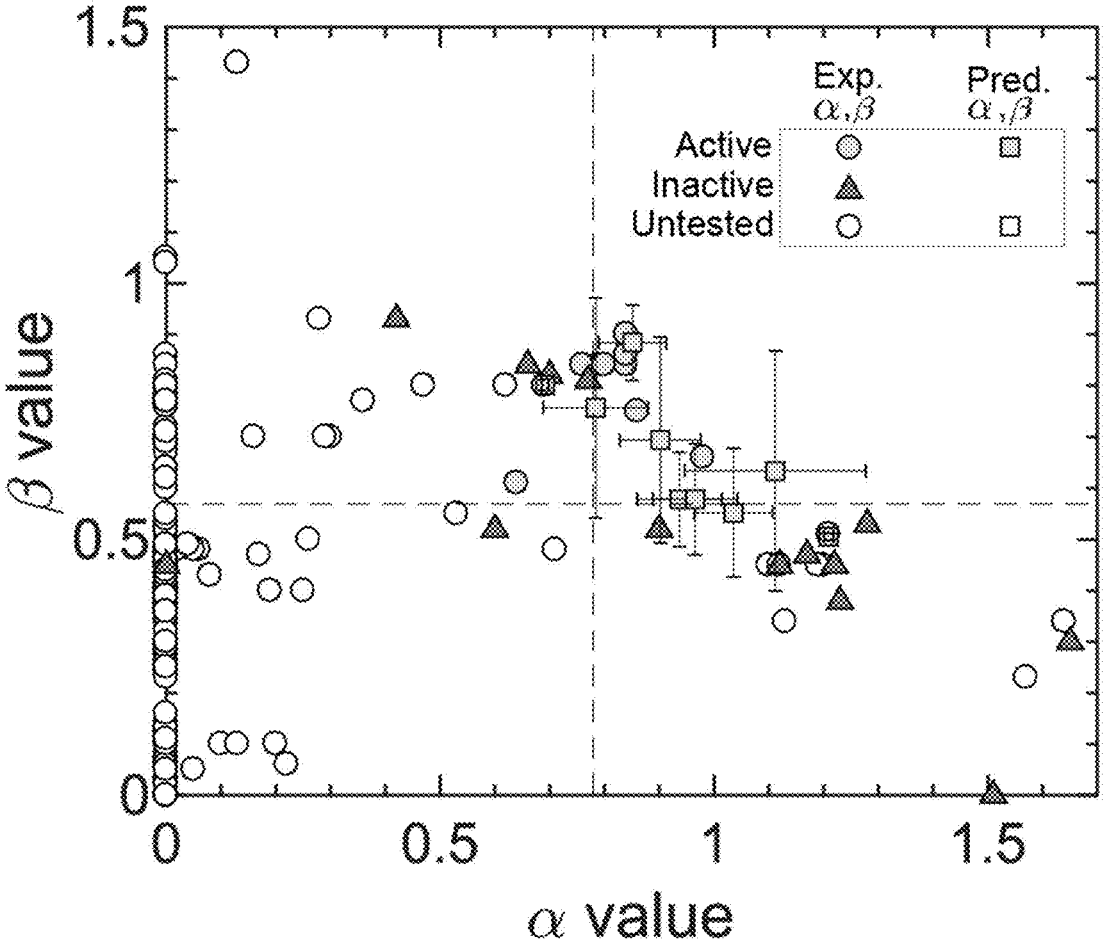
FIG. 3B illustrates a range of proton donors plotted in the $\alpha$-$\beta$ space with values either experimentally measured or predicted from developed deep learning model parameter values. Black dashed lines correspond to $\alpha_t$ and $\beta_t$, showing the desired quadrant for promising proton donors. Error bars along the two axes represent one standard deviation from the ensemble of prediction models.

Using these properties, a range of models (linear and non-linear supervised learning models, regression models, decision trees) were built and trained to predict the observed binary experimental activity classification. With training data composed of all the aforementioned properties curated from existing literature (Marcus 1993. "The Properties of Organic Liquids That Are Relevant to Their Use as Solvating Solvents." Chem. Soc. Rev. 22 (6). The Royal Society of Chemistry: 409-16; Meyer and Maurer 1995. "Correlation and Prediction of Partition Coefficients of Organic Solutes Between Water and an Organic Solvent with a Generalized Form of the Linear Solvation Energy Relationship." *Ind. Eng. Chem. Res.* 34 (1). ACS Publications: 373-81; Stenutz, Roland. accessed June 2020. "Kamlet-Taft Solvent Parameters." http://www.stenutz.eu/chemsolv26.php) and our DFT relaxation, we find that remarkably high classification ability (~96% accuracy) is associated with an interpretable decision tree (FIG. 3A) that takes as input two Kamlet-Taft parameters commonly denoted as $\alpha$ and $\beta$, which quantify solvent hydrogen-bond donating and accepting ability, respectively. The decision tree arose through cross-validation, which was used to balance tree complexity and misclassification error of the model. This is shown in FIG. 3B, which illustrates a range of proton donors plotted in the $\alpha$-$\beta$ space with values either experimentally measured or predicted from developed deep learning model parameter values. Black dashed lines correspond to threshold values for $\alpha$ and $\beta$, $\alpha_t$=0.78 and $\beta_t$=0.57, showing the desired quadrant for promising proton donors.

The obtained decision tree (FIG. 3A) identifies a simple rationalizable criterion for above-threshold activity towards electrochemical ammonia production: $\alpha_t>0.78$ and $\beta_t>0.57$. The identified classification can be rationalized based on the fact that promising proton donors should exhibit both high proton donating ($\alpha>\alpha_t$) and accepting ability ($\beta>\beta_t$). Such a criterion can be rationalized as the key nitrogen fixation reaction ($6Li+N_2\rightarrow 3Li_3N$) involves formation of undercoordinated lithium ions (Li+), the closest chemical analogue to a proton, during formation of lithium nitride; these ions can be stabilized by the basicity of the proton donor ($\beta$), thus accelerating nitrogen fixation. The need for a threshold solvent acidity ($\alpha$) can be rationalized by the fact that the nitrogen must be protonated to ultimately produce ammonia; stabilization of deprotonated forms of nitrogen during reduction may accelerate the fixation reaction. Alternatively, proton donating character may be necessary for promoting the formation of defect sites in the lithium metal, which may be necessary for formation of lithium nitride (McFarlane and Tompkins 1962. "Nitridation of lithium." *Trans. Faraday Soc.* 58: 997.). An inherent proton donating-accepting tradeoff emerges in the $\alpha$-$\beta$ space (FIG. 3B) where only a fraction of candidates strike a balance of above identified threshold values.

Experimental

Materials. Tetrahydrofuran (THF, 99+%, stabilized with BHT), molecular sieves (3 Å, 4-8 mesh), 1-propanol (99+%, extra pure), and 2-methyl-1-propanol (isobutanol, ACS reagent, spectro grade, 99+%) were purchased from Acros Organics, Carlsbad, CA, USA. Lithium tetrafluoroborate ($LiBF_4$, 98%), tert-butyl alcohol (99%), 2-butanol (>99%), 2-ethyl-1-butanol (98%), 1-pentanol (ACS reagent, ≥99%), 1-hexanol (reagent grade, 98%), 1-heptanol (98%), 1-nonanol (98%), benzyl alcohol (99.8%, anhydrous), phenol (unstabilized, ≥99%), 1-phenylethanol (98%), 2-phenylethanol (99%), 2-chloroethanol (99%), 2,2,2-trifluoroethanol (ReagentPlus, ≥99%), hexafluoro 2-propanol (≥99%), ethylene glycol (anhydrous, 99.8%), 1,3-butanediol (±, 99%, anhydrous), glycerol (ReagentPlus, ≥99%), triethyleneglycol (ReagentPlus, 99%), 1,5-pentanediol (≥97%), acetic acid (ReagentPlus, ≥99%), hexanoic acid (≥99%), allyl alcohol (99%), 2-methoxyethanol (99.8%, anhydrous), 1-propanethiol (99%), hydrochloric acid (HCl, ACS Reagent, 37%), sodium salicylate (ReagentPlus, ≥99.5%), and sodium hypochlorite (NaOCl, 10-15%) were purchased from Sigma-Aldrich, St. Louis MO, USA. Methanol (anhydrous, 99.9%), cyclohexanol (99%), 3-butene-1-ol (98+%), sodium nitroprusside (99-102%), and ammonium chloride ($NH_4Cl$, anhydrous, 99.99%) were purchased from Alfa Aesar, Ward Hill, MA, USA. Ethanol (Koptec, anhydrous, 200 proof), 2-propanol (Semi grade, BDH), sodium hydroxide (NaOH, Macron Fine Chemicals, pellet form), and acetone (ACS, BDH Chemical) were purchased from VWR International, Radnor, PA, USA. 1-butanol (Certified ACS), 3-methyl-1-butanol (isoamyl alcohol, for molecular biology), dichloromethane (DCM, 99.5%), and hexanes ($C_6H_{14}$) were purchased from Fisher Scientific, Waltham, MA USA. Formic acid (ACS Reagent, 98-100%) was purchased from EMD Millipore, St. Louis, MO, USA. Milli-Q water was obtained by filtering deionized (DI) water through a Milli-Q purification system (Merck, Millipore Corporation, Billerica, MA, USA). Platinum foil (Pt, 0.025 mm thick, 99.99%, trace metals basis) and 1-octanol (99%) were purchased from Beantown Chemical, Hudson, NH, USA. Argon gas (UHP, 5.0 grade) was purchased from Airgas, Radner, PA, USDA. Nitrogen gas was available in-house; it is generated by boil-off of liquid nitrogen from Airgas. Steel foil (cold-worked 304 stainless steel, 0.002" thick) was purchased from McMaster-Carr, Elmhurst, IL, USA. Polyporous Daramic™ 175 separators were received as a sample from Polypore International Inc., Charlotte, NC, USA.

Electrolyte preparation. Dry molecular sieves were prepared by washing as-purchased or previously used molecular sieves with acetone and drying in a muffle furnace at 300° C. for 5 hours. The sieves were added as 20% by volume to as-purchased THF in a round-bottom flask. The flask was sealed from the atmosphere with a rubber septum are dried for at least 96 hours before use. As purchased $LiBF_4$ was dissolved in dry THF to obtain a 1 M $LiBF_4$ in THF electrolyte solution. The $LiBF_4$ should be sufficiently pure for successful ammonia production; it was found that salt purchased from Sigma-Aldrich is sufficiently pure for these experiments. The solution was centrifuged at 6000 rpm (4430 rcf) to remove insoluble precipitates. The clear solution was transferred to oven-dried vials, stored in a desiccator, and used within 12 hours of preparation. The solution transfer operations can be performed in the ambient atmosphere; the solutions should not be stored open to the atmosphere, however, as the electrolyte solution can absorb a significant amount of water from ambient air.

The proton donor was added to the electrolyte immediately prior to experiments. The total volume of proton donor-containing electrolyte solution prepared for each experiment is 4 mL. If the volume of proton donor that needs to be added to obtain the desired concentration is <100 μL, then the proton donor was added to 4 mL of electrolyte directly. If the volume required is >100 μL, then the proton donor added to a smaller volume of electrolyte that was rounded to the nearest 0.1 mL, so that the final volume of the proton donor in electrolyte solution would equal 4 mL. For example, to prepare 0.2 M ethanol, 47 μL of ethanol were added to 4 mL of electrolyte solution, while to prepare 0.6 M 1-butanol, 220 μL of 1-butanol were added to 3.8 mL of electrolyte solution.

Nitrogen reduction experiments. Polished stainless steel electrodes were used as the cathode. Stainless steel shims were cut into 2×2 cm pieces, wet with DI water, and polished with 400 grit followed by 1500 grit sandpaper thoroughly. The polished foils were rinsed thoroughly with DI water and dried in air at 80° C. Stainless steel cathodes were used in a single experiment before discarding.

Parallel plate cells described in prior work were used to perform nitrogen reduction experiments (Lazouski et al. 2019). Briefly, a polished steel foil was used as the cathode, a platinum foil was used as the anode, a piece of Daramic™ was used as a separator, and machined polyether ether ketone (PEEK) cell parts were used for the cell body. All cell parts were dried in air at 80° C. for at least 20 minutes prior to use.

Nitrogen (or argon, in control experiments) gas was flowed at 10 standard cubic centimeters per minute (sccm) through a vial containing THF and molecular sieves to saturate the feed gas with THF. The THF-saturated feed gas was then flowed to an assembled 2-compartment cell. The proton-donor electrolyte was added first to the anode compartment, then to the cathode compartment. 1.75 mL of electrolyte was added to each compartment; note that this is the volume added to each compartment, and may not be the final volume in each compartment at the conclusion of the experiment due to solvent evaporation. The feed gas was flowed through the electrolyte for 10 minute at open circuit to saturate the electrolyte with gas and to strip oxygen from the solution.

Figure 4:
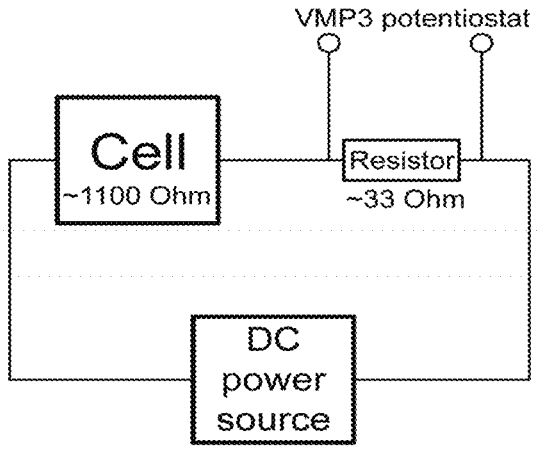
FIG. 4 is a diagram of a setup used to measure charge passed in the experiments described herein.

FIG. 4 is a diagram of the wiring scheme used to measure charge passed in the experiments. As the DC power source cannot independently quantify charge, the current passed through the circuit was measured with an accurate VMP3 potentiostat (Biologic, Seyssinet-Pariset, France). After saturating the solution with the feed gas, a constant current of 20 mA was applied for 6 minutes using a Tekpower 5003 DC power source, (Tekpower, Montclair, CA, USA) for a total of 7.2 coulombs of charge passed. In some experiments (see Table 1 below), the potential required to applied 20 mA exceeded 50 V. In experiments where an excess of 50 V was required to apply 20 mA, a constant potential of 50 V was applied across the cell for 6 minutes, and the total charge passed was quantified by measuring the potential drop across a resistor in series with the cell (FIG. 4). As the electrolyte resistance does not significantly change with concentration of most proton donors, the higher voltage required is likely due to changes in solid electrolyte interface (SEIs) at the cathode or anode in these experiments.

Following application of current, the electrolyte in the cathode compartment (catholyte) was immediately removed from the cell and diluted in water. In most experiments, the electrolyte was used directly to prepare samples for ammonia quantification. In these cases, the samples were made as follows: one by adding 200 μL of catholyte to 1800 μL of Milli-Q water (10-fold dilution), and another by adding 100 μL of catholyte to 1900 μL of water (20-fold dilution), to be able to accurately quantify ammonia at both lower and higher Faradaic efficiencies. In some cases, the proton donor can affect the colorimetric assay negatively by either phase separating with water (e.g. octanol), leading to higher spurious absorbances, or chemically (e.g. ethyl acetate, thiols), leading to lower or shifted absorbances. In these cases, the proton donor was extracted from the ammonia-containing samples. To extract the proton donor, 500 μL of electrolyte were added to 4.5 mL of 0.05 M $H_2SO_4$ in water. The proton donor in resulting acidified solution was extracted with 3 mL of either DCM or hexanes three times. Milli-Q water was then added to the aqueous phase to a final volume of 5 mL if the volume decreased, which may occur if the THF was extracted into the organic phase. The aqueous phase was centrifuged at 6000 rpm (4430 rcf) for 10 minutes to promote complete phase separation. The aqueous phase was then quenched with base by adding 1500 μL of the acidified solution to 500 μL of 0.4 M NaOH, or by adding 750 μL of the acidified solution to 250 μL of 0.4 M NaOH and 1000 μL of Milli-Q water.

After experiments, Daramic™ separator pieces were rinsed with acetone and soaked in DI water for at least 10 minutes to remove traces of solvent and ammonia. Cell parts and platinum anodes were rinsed with acetone and washed thoroughly with DI water. All cell parts, electrodes, and separators were dried at 80° C. in air prior to use in further experiments.

In order to determine whether a proton donor can be used to produce ammonia using the lithium-mediated approach, a range of proton concentrations had to be efficiently screened for activity. From prior work (Lazouski et al. 2019), it is known that ammonia yields depend on the concentration of ethanol, the proton donor. At low concentrations, no ammonia is formed and a large amount of lithium remains on the cathode, while at high concentrations, no ammonia is formed due to competition from the hydrogen evolution reaction. We posited that this behavior is not unique to ethanol and can be observed for various proton donors. From this hypothesis, we developed a heuristic to rapidly screen the concentration range. Initially, electrolyte containing 0.2 M of the proton donor was used to test for ammonia production. If a significant amount of lithium metal was found to remain on the cathode or in solution, the concentration of the proton donor was increased for the next run. Typically, the concentration was increased 2- or 3-fold, depending on the extent of lithium coverage on the surface. If the surface is clean and the steel cathode is visible, the concentration of the proton donor was decreased by a similar amount. Every proton donor was tested at three concentrations, with a maximum concentration tested of 1 M. The 1 M cutoff is arbitrary, and was chosen as it is a concentration that results in fairly large volume fractions of proton donor in electrolyte for most proton donors. Using this heuristic, we typically obtained runs with a high lithium coverage after the experiment, a low lithium coverage, and an intermediate coverage, except for cases where 1 M of proton donor did not decrease lithium coverage; in these cases, all experiments had a large lithium coverage. We believe that approach allowed us to probe a large compound-concentration phase space efficiently to determine which compounds are capable of promoting lithium-mediated nitrogen reduction.

Figure 5A:
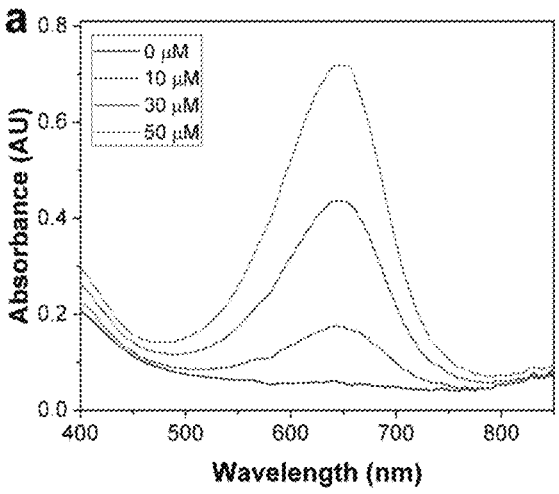
FIGS. 5A and 5B are typical ammonia quantification calibration curves.
Figure 5B:
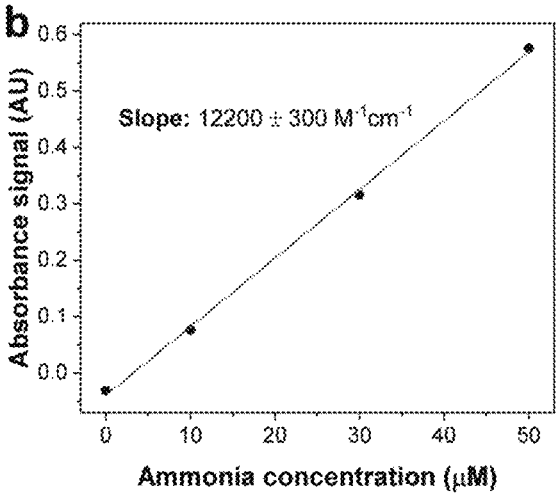

The amount of ammonia in samples produced in nitrogen reduction experiments was quantified by using the salicylate assay according to a procedure described in earlier work (Lazouski et al. 2019). Briefly, 280 μL of 1% NaOCl in 0.4 M NaOH solution was added to 2 mL of ammonia sample solution, followed by 280 μL of 2.5 M sodium salicylate, 3.5 mM sodium nitroprusside solution. The resulting solution was mixed vigorously and left to evolve color in the dark for at least 2 hours. The absorbance spectrum of the resulting solution was measured using an Ocean Optics Flame-S UV-Vis spectrophotometer (Ocean Optics, Inc., Dunedin, FL USA). The relevant signal for ammonia quantification was taken to be the difference in absorbance values at 650 nm and 475 nm to avoid overestimating the amount of ammonia produced (Lazouski et al. 2019). A fresh ammonia calibration curve was made for each quantification batch. Calibration curves were made by adding 100 μL of electrolyte to solutions of known ammonium sulfate concentrations, ranging from 0 to 80 μM. A typical calibration curve and absorbance spectra can be seen in FIGS. 5A and 5B.

Addition of most proton donors to the electrolyte used do not change the calibration curve significantly; proton donors which may affect the quantification (such as thiols or long chain alcohols) were typically removed by extraction prior to quantification (see Table 1). The lowest accurately quantifiable concentration of ammonia in the solutions was typically 2 μM, computed from the error in the intercept of the calibration curve. Assuming a ten-fold dilution of the electrolyte solution to make a sample, the minimum quantifiable ammonia FE from a typical experiment is 0.1%. Compounds considered active are designated "True" whereas compounds considered inactive are designated "False".

TABLE 1

| Compound Name | Max FE (%) | Max FE error (%) | Conc. at max FE (M) | Charge (C) | Extraction solvent | Experimental activity classification |
|---|---|---|---|---|---|---|
| 1,2-propanediol | 0.04 | 0.02 | 0.2 | 7.2 | None | False |
| 1,3-butanediol | 1.65 | 0.17 | 0.2 | 7.2 | None | True |
| 1,3-propanediol | 8.38 | 1.51 | 0.1 | 7.2 | None | True |
| 1,4-cyclohexane | 0.02 | 0.05 | 0.2 | 7.2 | None | False |

TABLE 1-continued

| Compound Name | Max FE (%) | Max FE error (%) | Conc. at max FE (M) | Charge (C) | Extraction solvent | Experimental activity classification |
|---|---|---|---|---|---|---|
| dimethanol | | | | | | |
| 1,5-pentanediol | 4.43 | 1.39 | 0.2 | 1.5 | None | True |
| 1-butanol | 15.58 | 5.29 | 0.1 | 7.2 | None | True |
| 1-decanol | 0.09 | 0.05 | 1 | 7.2 | Hexane | False |
| 1-heptanol | 2.19 | 0.08 | 1 | 7.2 | Hexane | True |
| 1-hexanol | 7.79 | 0.55 | 0.6 | 7.2 | Hexane | True |
| 1-nonanol | 0.18 | 0.08 | 0.6 | 7.2 | Hexane | False |
| 1-octanol | 0.08 | 0.05 | 0.2 | 7.2 | Hexane | False |
| 1-pentanol | 10.42 | 3.06 | 0.2 | 7.2 | None | True |
| 1-phenylethanol | 1.02 | 0.20 | 0.8 | 7.2 | None | True |
| 1-propanol | 9.93 | 1.20 | 0.1 | 7.2 | None | True |
| 2,2,2-trifluoroethanol | 0.02 | 0.06 | 0.4 | 7.2 | None | False |
| 2,2-difluoroethanol | 0.02 | 0.00 | 0.5 | 7.2 | None | False |
| 2,2-dimethyl-1,3-propanediol | 0.84 | 0.17 | 0.4 | 7.2 | None | True |
| 2-butanol | 1.36 | 0.06 | 1 | 7.2 | None | True |
| 2-chloroethanol | 0.06 | 0.02 | 0.2 | 7.2 | None | False |
| 2-ethyl-1-butanol | 3.62 | 0.59 | 0.2 | 7.2 | None | True |
| 2-phenylethanol | 1.64 | 0.26 | 0.9 | 7.2 | None | True |
| 3-butene-1-ol | 1.94 | 0.08 | 0.6 | 7.2 | None | True |
| 4-methoxybutan-1-ol | 0.34 | 0.02 | 0.4 | 7.2 | None | False |
| Acetic acid | 0.19 | 0.07 | 0.07 | 7.2 | None | False |
| Allyl alcohol | 0.69 | 0.14 | 0.6 | 7.2 | None | True |
| Benzyl alcohol | 0.34 | 0.21 | 0.8 | 7.2 | None | False |
| Cyclohexanol | 0.00 | 0.04 | 0.6 | 7.2 | None | False |
| Ethanol | 13.16 | 1.27 | 0.1 | 7.2 | None | True |
| Ethyl acetate | 0.15 | 0.06 | 0.2 | 7.2 | DCM | False |
| Ethylene glycol | 0.44 | 0.03 | 0.4 | 4.1 | None | False |
| Formic acid | 0.00 | 0.07 | 0.2 | 7.2 | None | False |
| Glycerol | 4.20 | 0.45 | 0.2 | 4.6 | None | True |
| Hexafluoro isopropyl alcohol | 0.03 | 0.09 | 0.4 | 7.2 | None | False |
| Hexanoic acid | 0.00 | 0.07 | 0.2 | 7.2 | None | False |
| Isoamyl alcohol | 6.74 | 2.24 | 0.6 | 7.2 | None | True |
| Isobutanol | 3.09 | 0.43 | 0.4 | 7.2 | None | True |
| Isopropyl alcohol | 3.12 | 0.61 | 0.2 | 7.2 | None | True |
| Lactic acid | −0.03 | 0.22 | 0.1 | 7.2 | None | False |
| Methanol | 6.55 | 1.41 | 0.2 | 7.2 | None | True |
| Phenol | −0.05 | 0.06 | 0.2 | 7.2 | None | False |
| Propanethiol | 0.03 | 0.03 | 0.1 | 7.2 | DCM | False |
| t-butyl alcohol | 0.57 | 0.08 | 0.6 | 7.2 | None | False |
| Triethylene glycol | −0.15 | 0.03 | 0.2 | 7.2 | None | False |
| Water | −0.06 | 0.02 | 0.2 | 7.2 | None | False |

Examples of implementations of the invention described herein are for purposes of illustration only and are not to be taken as limiting the scope of the invention in any way. The scope of the invention is currently set forth in the following claims.

What is claimed is:

1. A system for the electrochemical production of NH3 from nitrogen gas and a hydrogen-containing molecule, wherein the system comprises:

(a) an electrochemical cell that comprises a cathode, an anode and a lithium-ion containing electrolyte disposed between the cathode and the anode, and wherein the system is configured to operate the electrochemical cell under conditions such that (i) lithium ions in the electrolyte are converted to lithium metal at the cathode, wherein the lithium metal reacts with nitrogen gas to form Li3N, and wherein the Li3N reacts with protons in a proton donor to form NH3, lithium ions and a proton acceptor and wherein the proton donor has a Kamlet-Taft alpha parameter (α) greater than 0.7 and a Kamlet-Taft beta parameter (β) greater than 0.5 and (ii) protons are generated from the hydrogen-containing molecule at the anode, wherein the protons react with the proton acceptor to produce the proton donor;

(b) a source of the nitrogen gas; and (c) a source of the hydrogen-containing molecule;

wherein the proton donor is (a) an ionic liquid comprising a cation that has a Kamlet-Taft alpha parameter (α) greater than 0.7 and a Kamlet-Taft beta parameter (β) greater than 0.5, (b) an ionic liquid comprising a anion that has a Kamlet-Taft alpha parameter (α) greater than 0.7 and a Kamlet-Taft beta parameter (β) greater than 0.5, or (c) and an ionic liquid comprising a cation that has a Kamlet-Taft alpha parameter (α) greater than 0.7 and a Kamlet-Taft beta parameter (β) greater than 0.5 and a anion that has a Kamlet-Taft alpha parameter (α) greater than 0.7 and a Kamlet-Taft beta parameter (β) greater than 0.5.

2. The system of claim 1, wherein the cation is selected from ammonium, azepanium, benzimidazolium, 1,8-diazabicyclo[5.4.0]undec-7-ene (DBU), guanidinium, imidazolium, morpholinium, octanium, oxazolidinium, phosphonium, piperidinium, pyrazolium, pyridinium, pyrimidinium, pyrrolidinium, sulfonium and triazolium and/or wherein the anion is selected from sulfonate, sulfate, phosphonate, phosphate, bis(trifluoromethanesulfonyl)imide (NTf2), nitrate, halide, dicyanamide, carboxylate, BF4, acetate, phosphite, perchlorate, tricyanomethanide, thiocyanate, PF6, SbF6, and dimethoxy(oxo)phosphanuide.

3. The system of claim 1, wherein the hydrogen-containing molecule is selected from hydrogen gas, water, or an organic hydrogen-containing molecule.

4. The system of claim 3, wherein the organic hydrogen-containing molecule is a tetrahydrofuran.

5. The system of claim 1, further comprising an ionically conductive separator positioned between the anode and the cathode.

6. The system of claim 1, further comprising a voltage source for supplying energy to operate the electrochemical cell.

7. The system of claim 1, wherein the electrolyte comprises a lithium salt dissolved in a solvent for the lithium salt.

8. The system of claim 7, wherein the lithium salt is selected from lithium tetrafluoroborate ($LiBF_4$), lithium hexafluorophosphate ($LiPF_6$), lithium hexafluoroarsenate ($LiAsF_6$), lithium perchlorate ($LiClO_4$), lithium triflate ($LiCF_3SO_3$), lithium bisoxalato borate (LiBOB), lithium difluorooxalato borate (LiDFOB), lithium trifluorosulfonylimide (LiTFSI).

9. The system of claim 7, wherein the solvent for the lithium salt is selected from ether-containing organic solvents, fluorinated organic solvents and lactones.

10. The system of claim 7, wherein the solvent for the lithium salt and the hydrogen-containing molecule are the same.

11. The system of claim 1, wherein the cathode is formed from a metal or a metal oxide.

12. The system of claim 1, wherein the cathode is selected from transition metals and alloys of transition metals.

13. The system of claim 1, wherein the anode is platinum metal.

14. The system of claim 1, wherein the electrochemical cell is operated at a current density greater than 300 mA/cm2.

* * * * *